US005734231A

United States Patent [19]

Lee et al.

[11] Patent Number: 5,734,231

[45] Date of Patent: Mar. 31, 1998

[54] INSTANT LIGHTING TYPE FLUORESCENT LAMP LIGHTING CIRCUIT

[76] Inventors: Chung Woo Lee, 27-204, Banpo Apt. 1005 Banpo Dong Seocho-Ku, Seoul, Rep. of Korea; Yong K. Park, 101-701 Chung Ang Heights, Sagun Dong, Sungdong-Ku, Seoul, Rep. of Korea

[21] Appl. No.: 698,899

[22] Filed: Aug. 16, 1996

[30] Foreign Application Priority Data

Aug. 21, 1995 [KR] Rep. of Korea ..... 25688/1995

[51] Int. Cl.[6] ..... H05B 37/02

[52] U.S. Cl. ..... 315/106; 315/107; 315/289

[58] Field of Search ..... 315/106, 105, 315/107, 289, 290

[56] References Cited

U.S. PATENT DOCUMENTS 4,603,281 7/1986 Nilssen ..... 315/106

5,010,274 4/1991 Phillips et al. ..... 315/106

FOREIGN PATENT DOCUMENTS

5026/1996 6/1996 Rep. of Korea .

*Primary Examiner*—Robert Pascal
*Assistant Examiner*—Michael Shingleton
*Attorney, Agent, or Firm*—Brooks & Kushman, P.C.

[57] ABSTRACT

A fluorescent lamp lighting circuit is disclosed in which an instant lighting is possible, and a high reliability is ensured. Further, the circuit is compact, and the cost is low. The fluorescent lamp lighting circuit according to the present invention includes a discharge circuit section including a choke coil serially connected to a filament of a fluorescent lamp. It further includes a lighting circuit section connected serially to the filament and the choke coil so as to be turned on at certain intervals by supplying the power, and so as to be turned off after the starting of the glow discharge of the fluorescent lamp. It further includes a protecting circuit section for turning off the light circuit section after certain repetition of on/off operations of the lighting circuit section.

8 Claims, 11 Drawing Sheets

(a)

(b)

(a)

(b)

INSTANT LIGHTING TYPE FLUORESCENT LAMP LIGHTING CIRCUIT

BACKGROUND OF THE INVENTION

1. Field of the Invention

The present invention relates to an instant lighting circuit for a fluorescent lamp, in which a high frequency switching power is utilized so as to instantly light a fluorescent lamp in a simple manner, and a brightness adjustment is also possible.

2. Description of the Prior Art

Fluorescent lamps are higher by 3 to 5 times in lighting efficiency (In/watt) compared with incandescent lamps, and the life expectancy is also much longer. Therefore, fluorescent lamps are being used as an important artificial lighting source. However, fluorescent lamps have a generally negative resistance structure like a glow discharge lamp, and therefore, a relatively high discharge triggering voltage is required. Conventionally, in order to limit the tube current and to obtain a sufficient discharge triggering voltage, a glow starter and a stabilizer consisting of a choke coil are generally used. The glow starter utilizes a bimetal switch contact, and the current is momentarily varied upon opening it. Therefore, by the help of the stabilizer, a high spike voltage is generated at both ends of the lamp, and thus, the fluorescent lamp is lighted (refer to FIGS. 1 and 5). This method is simple and of low cost, but it has the disadvantage that several seconds are consumed until the lamp is lighted.

Further, there is known a rapid starting method in which the lamp is instantly lighted. However, in this method, a relatively large step-up transformer is used, and therefore, there are disadvantages such as a high cost, a high weight, a large current loss, and the use of an exclusive fluorescent lamp device (refer to FIG. 2).

In order to overcome the above described disadvantages, there is proposed an instant lighting circuit using semiconductor as shown in FIG. 3. Referring to FIG. 3, this device uses compensating turns of a choke coil so as to charge a disc by utilizing a diode conduction angle. Further, high voltage pulses are supplied to the compensating turns so as to supply it to the fluorescent lamp. Further, a triac SCR which is an AC bilateral control device charges to saturation (within a negative half cycle) by a non-linear over-saturation capacitor CN having charge saturation characteristics, and then, generates a reverse direction high voltage pulse within a positive half cycle. (Refer to FIG. 6).

In the case of the fluorescent lamp, a non-linear resistance discharge with a complicated load is accompanied. The stabilizer including the inductance portion is loaded, with the result that the discharge characteristics are widely varied due to a delayed power factor. The discharge characteristics include the lamp current state, the distorted plate voltage variation, the ambient temperature, a time-worn fluorescent lamp and the like. In this glow discharge tube characteristics having the complicated variations, the triggering type operation within an AC half cycle may cause imperfect lighting, or the circuit may terminate the operation in a blinking state.

Meanwhile, the electronic stabilizer which has come to be widely used recently is a forcible switching method for several scores of KHz used in the commercial power source. (refer to FIG. 4). In this stabilizer, the loss increases proportionally to the driving frequency, harmful electromagnetic waves are generated, the product is expensive, and other auxiliary costs are large. Further, the rise of voltage-current accompanied to the mechanical switch, a surge voltage, and an LC resonant circuit cause a phase shift of the switch, with a consequent circuit damage (refer to FIG. 7). Further, during the illumination, the AC phase angle control method remains as problematic.

In the field of illumination engineering, the lamp is driven by a high frequency, and other studies are being carried out to improve the lighting efficiency.

SUMMARY OF THE INVENTION

The present invention is intended to overcome the above described disadvantages of the conventional techniques.

Therefore it is an object of the present invention to provide a fluorescent lamp lighting circuit in which an instant lighting is possible, and a high reliability is ensured.

It is another object of the present invention to provide a fluorescent lamp lighting circuit in which an instant lighting is possible, the circuit is compact, and the cost is low.

In achieving the above objects, the fluorescent lamp lighting circuit according to the present invention includes: a discharge circuit section including a choke coil serially connected to a filament of a fluorescent lamp; a lighting circuit section connected serially to the filament and the choke coil so as to be turned on at certain intervals by supplying the power, and so as to be turned off after the glow discharge of the fluorescent lamp; and a protecting circuit section for turning off the lighting circuit section after certain repetitions of on/off operations of the lighting circuit section.

If the choke coil is not employed, the circuit of the present invention is replaced with a glow plug in a glow starter type fluorescent lamp device, so that the fluorescent lamp lighting device of the glow starter type can be modified into an instant lighting device in a simple manner.

During operation, a silicon control device may be used, in which the negative or positive conducting current bypasses the lighting circuit section, thereby supplying filament discharge promoting current.

In the present invention, the invertor method of rectifying the commercial power source by means of an electronic stabilizer so as to drive the fluorescent lamp by switching it with several scores of KHz is not used, but the following method is used. That is, as shown in FIG. 9, high speed switchings are carried out between discharge paths H1 and H2 of a fluorescent lamp F, and a short circuit current i1 which passes through the stabilizer sufficiently pre-heats the filament. For example, the short circuit current i1 which is turned on and off by a frequency of 1 KHz–20 KHz induces a voltage for initiating the glow discharge in the stabilizer, and then, the voltage is supplied to the both ends of the fluorescent lamp. When the fluorescent lamp is lighted, the short circuit current i1 is withdrawn, and the lighted state is maintained by a discharge current i2 which flows through the stabilizer across the both ends of the fluorescent lamp. The lighting operation is initiated by a relatively high frequency switching, and therefore, any flickering can be substantially eliminated.

If the lighting and discharge operations are carried out in a stable manner, even if the external voltage is varied, the voltage in the fluorescent lamp can be maintained at a constant level. Therefore, the input voltage can be adjusted by means of a transformer so as to control the brightness of the fluorescent lamp.

BRIEF DESCRIPTION OF THE DRAWINGS

The above object and other advantages of the present invention will become more apparent by describing in detail the preferred embodiment of the present invention with reference to the attached drawings in which.

DETAILED DESCRIPTION OF THE PREFERRED EMBODIMENT

Figure 1:
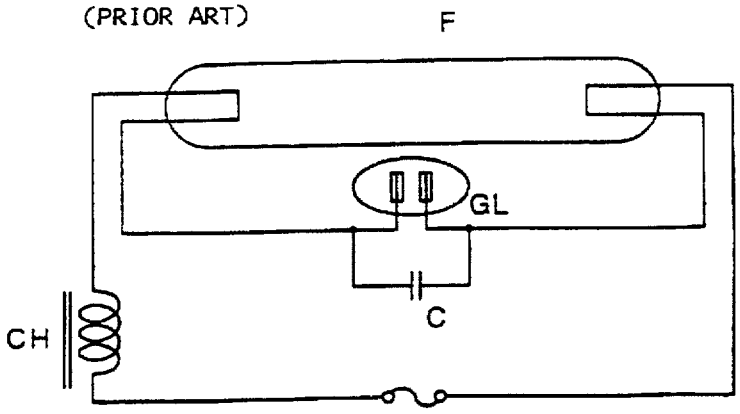
FIG 1 (PRIOR ART)
FIG. 1 is a circuital illustration for a glow starter type fluorescent lamp lighting circuit.
Figure 2:
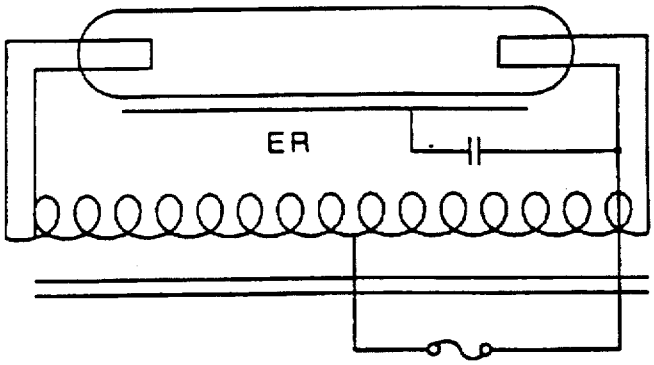
FIG 2 (PRIOR ART)
FIG. 2 is a circuital illustration for the conventional rapid start type fluorescent lamp lighting circuit.
Figure 3:
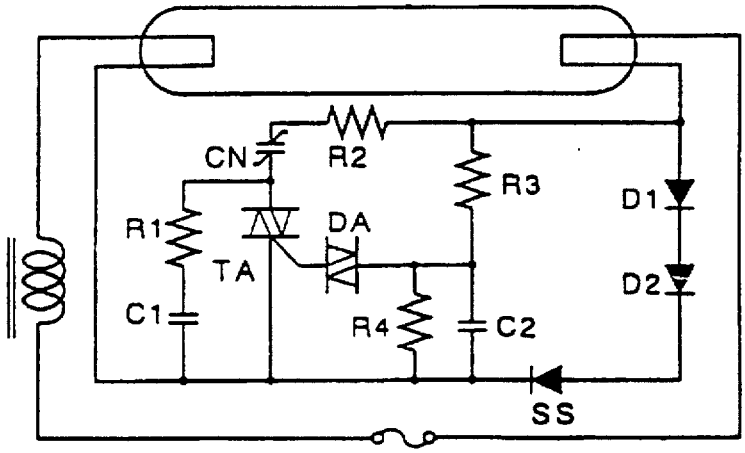
FIG 3 (PRIOR ART)
FIG. 3 is a circuital illustration for the conventional electronic starting circuit.
Figure 4:
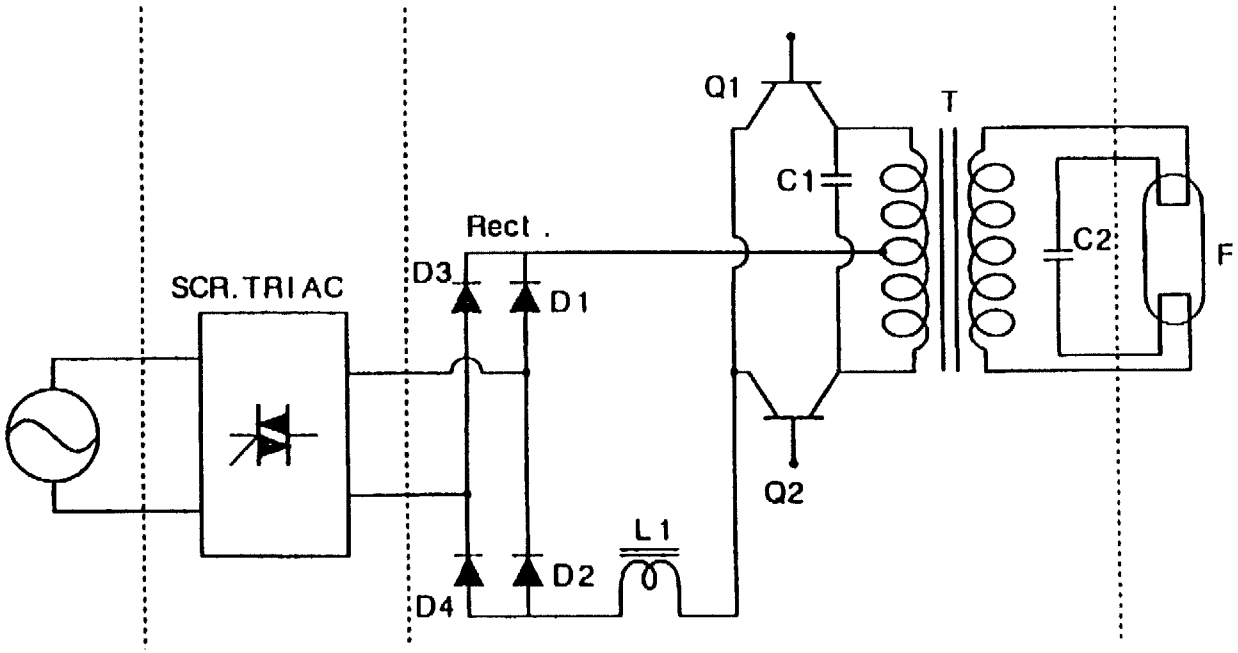
FIG 4 (PRIOR ART)
FIG. 4 is a circuital illustration for the conventional high frequency type fluorescent lamp lighting circuit.
Figure 5:
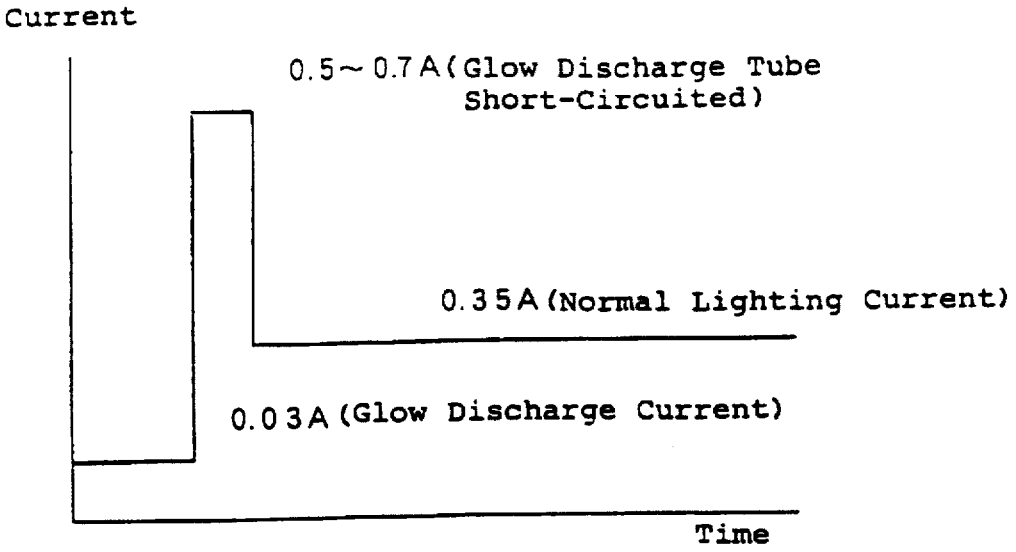
FIG 5 (PRIOR ART)
FIG. 5 illustrates the lighting wave patterns for the conventional glow start type fluorescent lamp lighting circuit.
Figure 6:
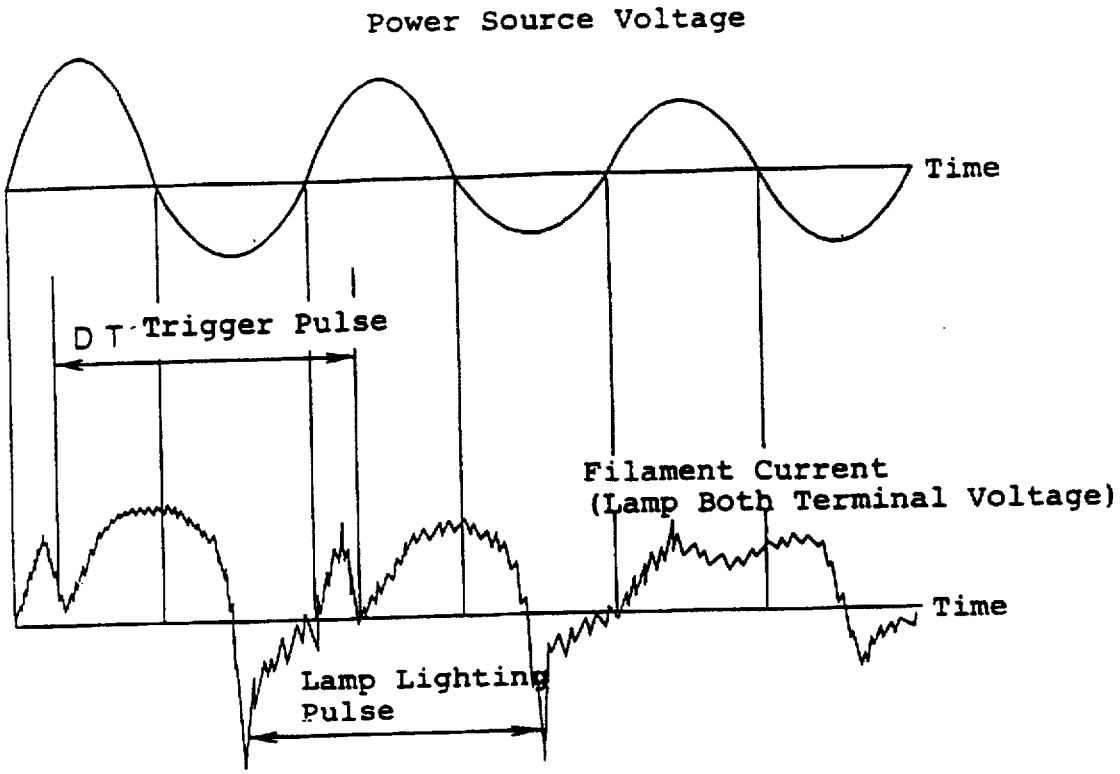
FIG 6 (PRIOR ART)
FIG. 6 illustrates the lighting wave patterns for the conventional electronic starting circuit.
Figure 7:
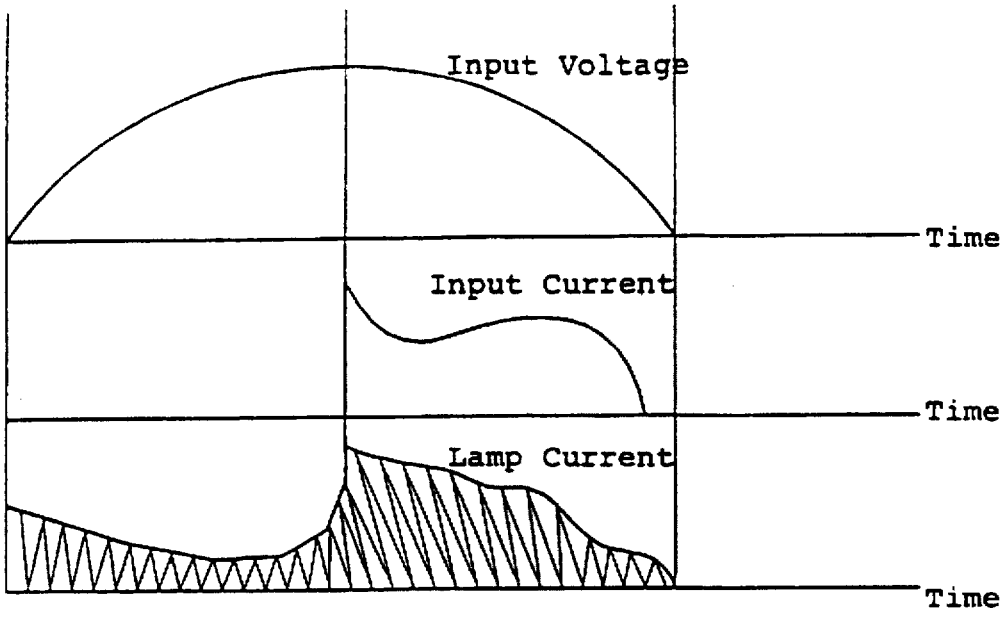
FIG 7 (PRIOR ART)
FIG. 7 illustrates the wave patterns for the conventional high frequency type fluorescent lamp lighting circuit.
Figure 8:
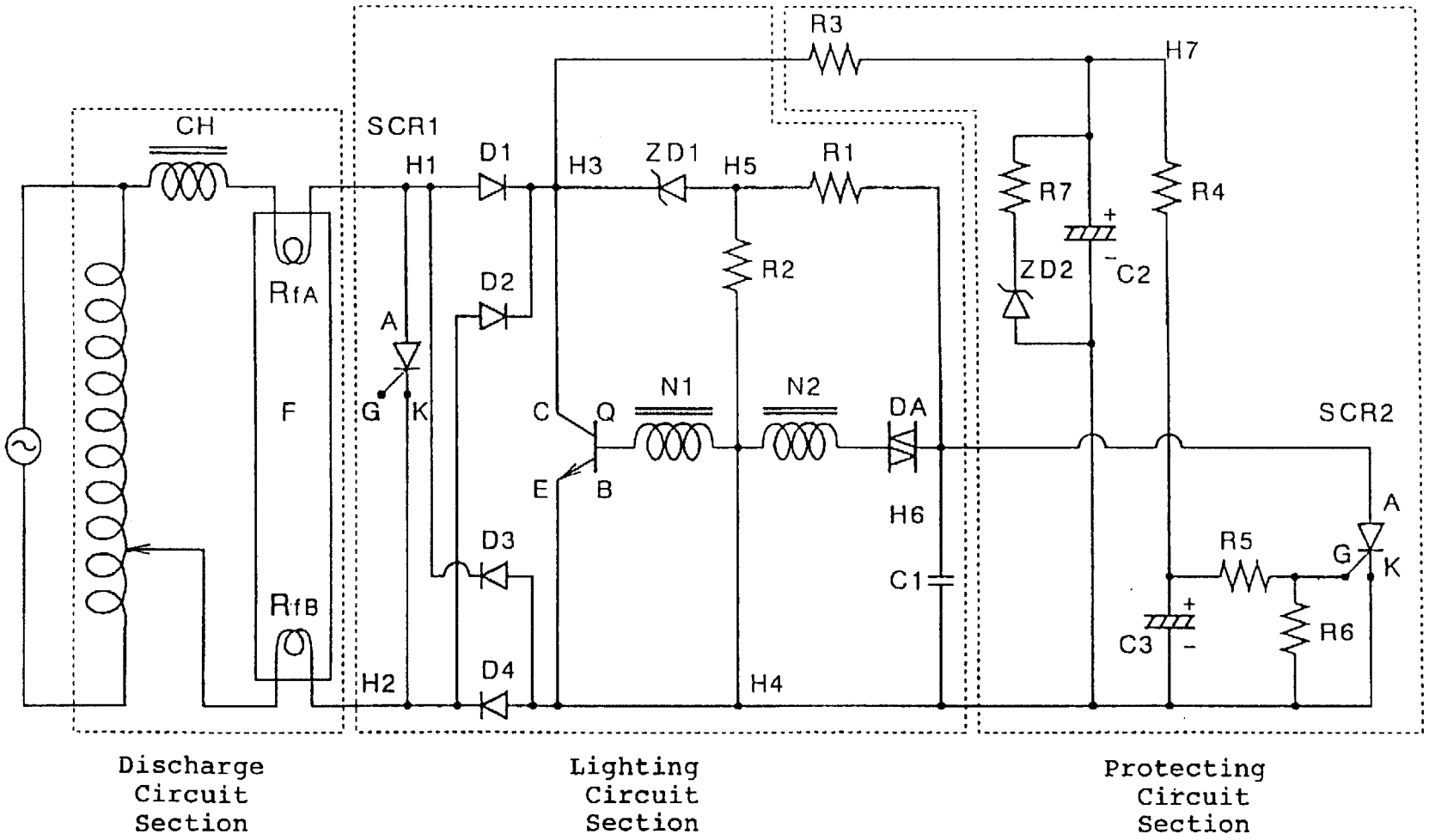
FIG. 8 is an overall circuital illustration for the instant lighting type fluorescent lamp lighting circuit according to the present invention.
Figure 9:
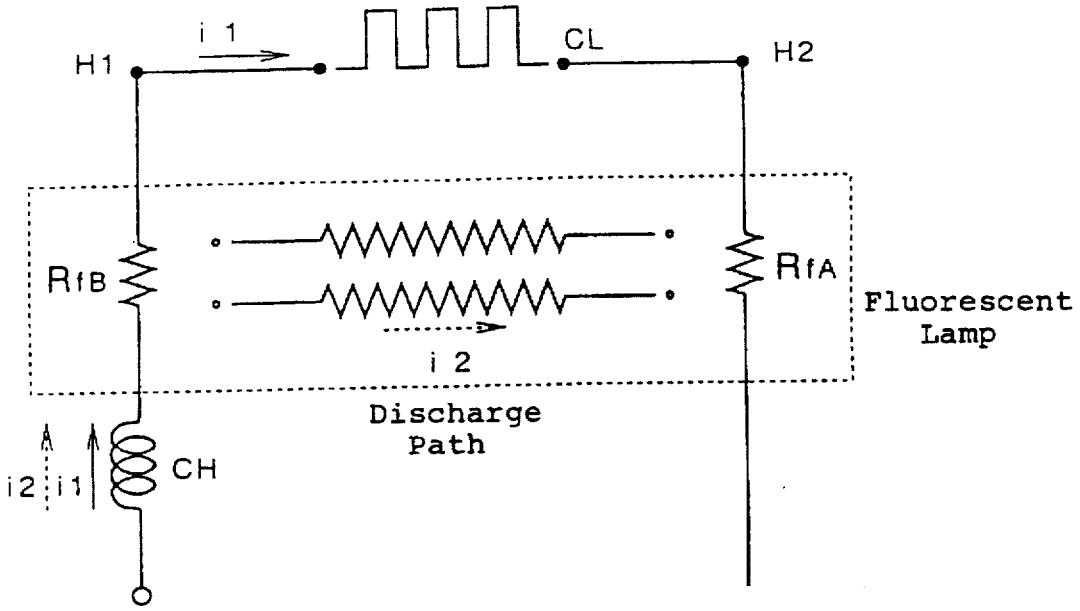
FIG. 9 is a diagram showing the operating principle of the fluorescent lamp lighting circuit according to the present invention.
Figure 10:
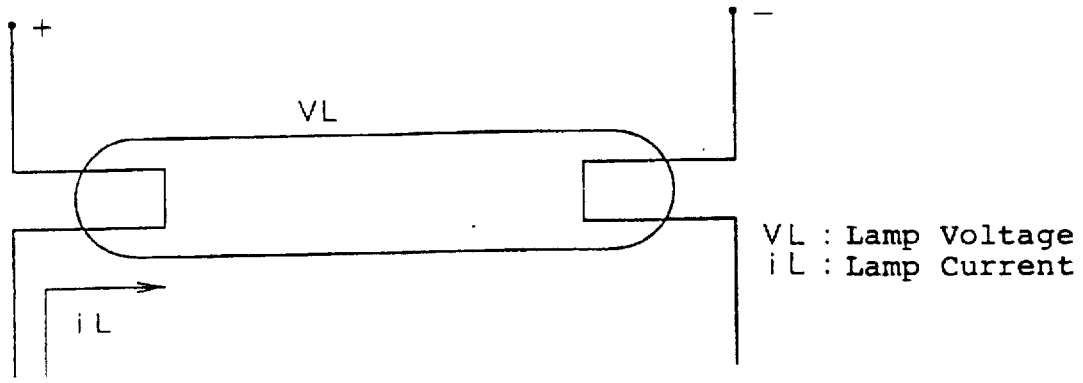
FIG. 10 is a graphical illustration showing the voltage versus current for the glow discharge path during the normal lighting in the present invention.
Figure 10:
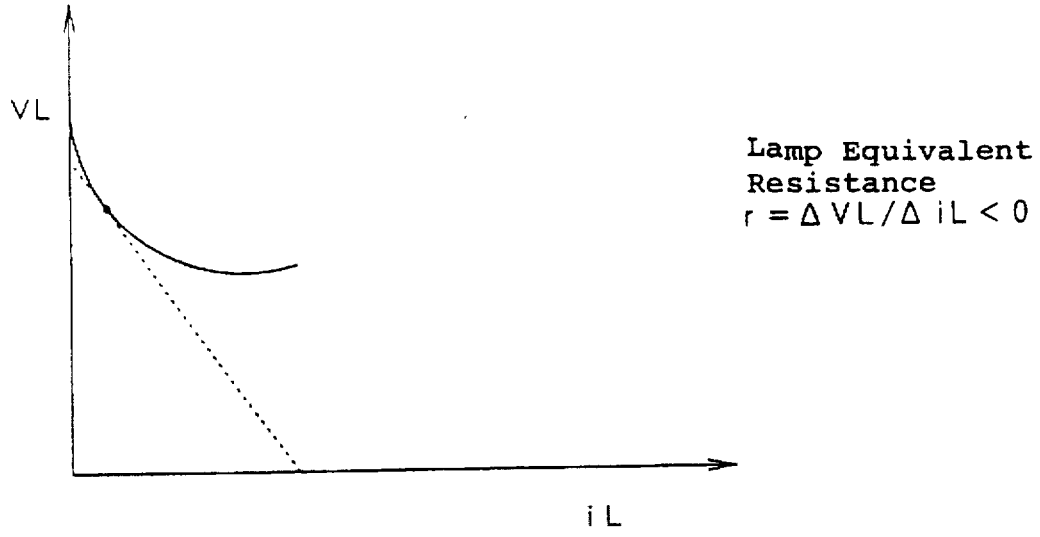
Figure 11:
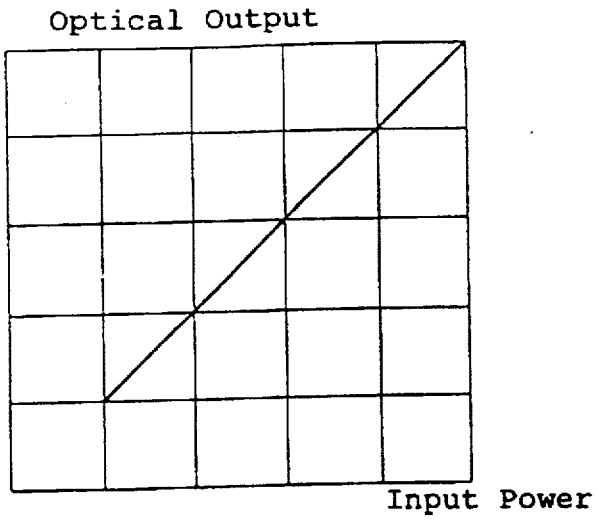
FIG. 11 is a graphical illustration showing the light output versus the lamp power and the lamp current for the lighting circuit according to the present invention.
Figure 11:
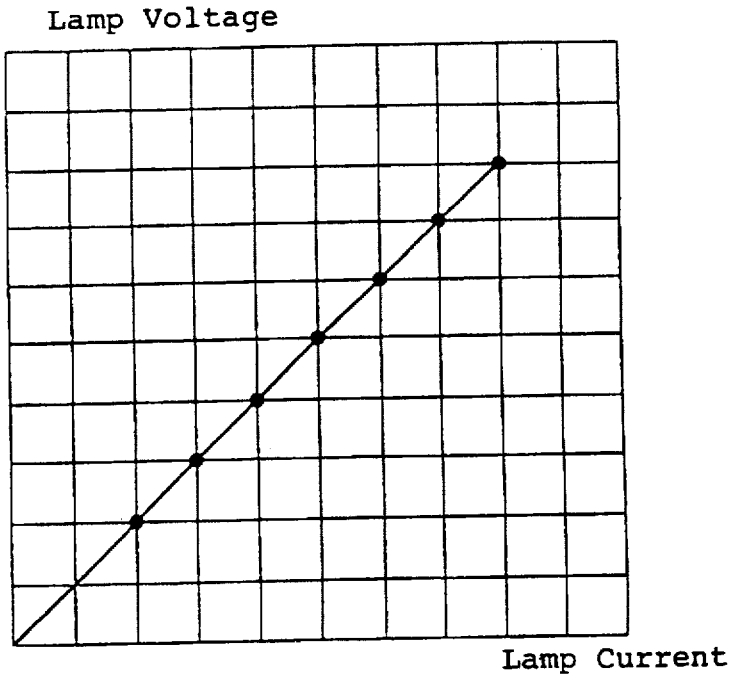
Figure 12:
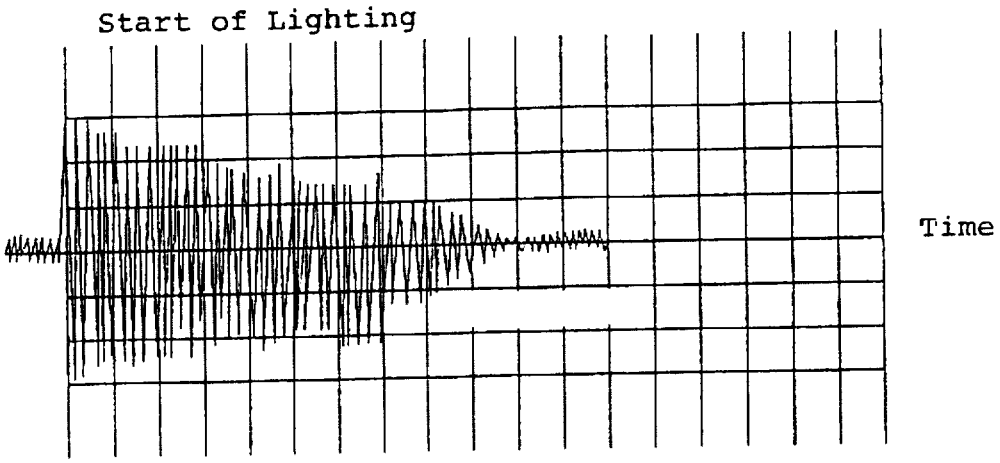
FIG. 12 illustrates the wave patterns during the lighting of the lighting circuit according to the present invention.
Figure 13:
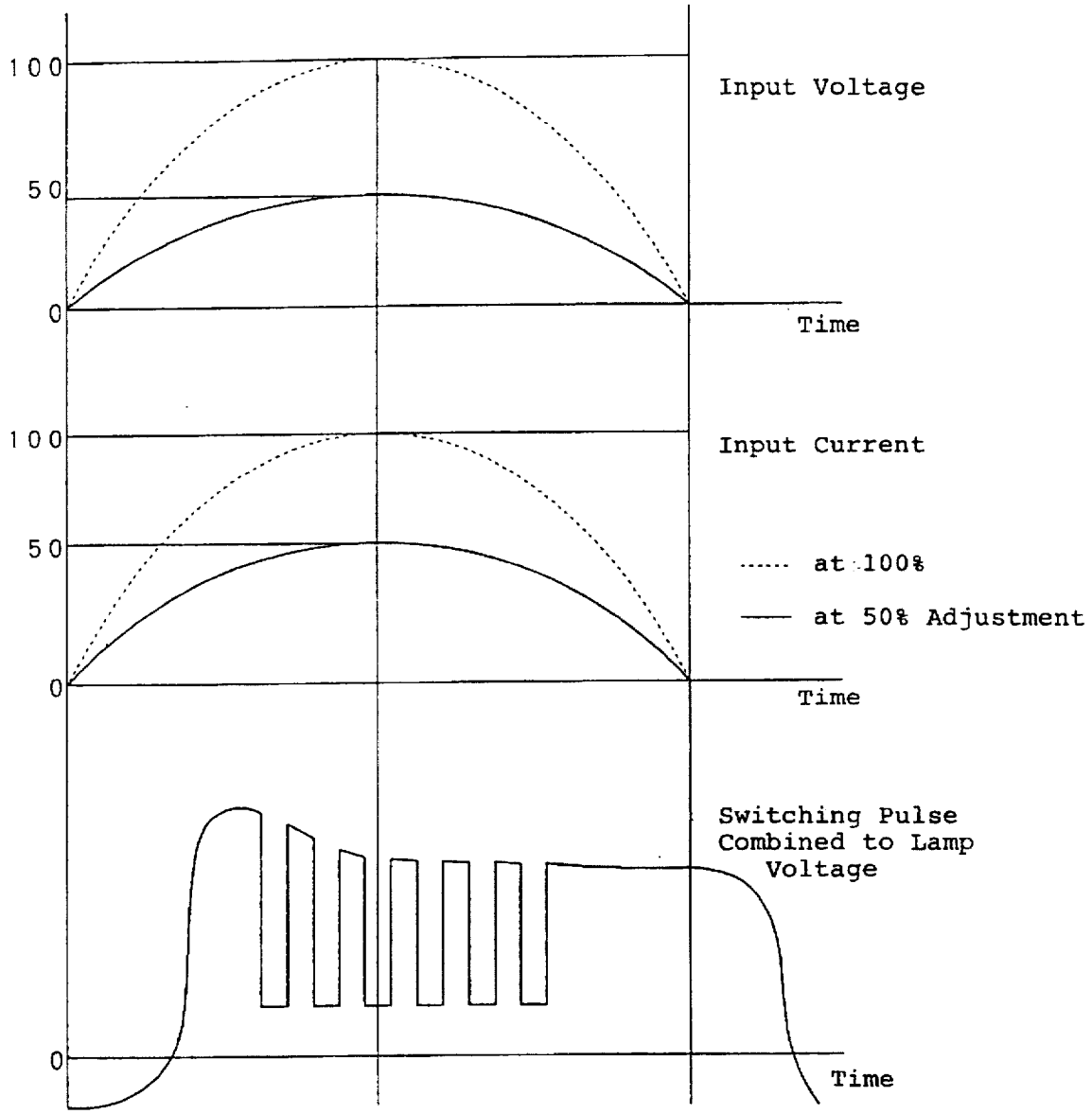
FIG. 13 illustrates wave patterns during a brightness adjustment in the lighting circuit according to the present invention.

Referring to FIG. 8, the fluorescent lamp lighting circuit according to the present invention includes: a discharge circuit section, a lighting circuit section, and a protecting circuit section.

The discharge circuit section maintains the glow discharge state of the fluorescent lamp. For example, an AC commercial power source of 100 V is supplied from a brightness controlling transformer T through a stabilizer (choke coil) CH to the both ends of a fluorescent lamp F. Then the power passes through filaments RfA and RfB at the respective stages to reach nodes H1 and H2.

The lighting circuit section starts the glow discharge of the fluorescent lamp. The node H1 is connected to an anode of a silicon control device SCR1, while the node H2 is connected to a cathode of the silicon control device SCR1. The gate of the silicon control device SCR1 is open. Further, the nodes H1 and H2 are connected to the input terminals of a rectifying bridge which consists of bridge diodes D1, D2, D3, and D4. Further, the positive output terminal of the bridge diode is connected to the collector of a transistor Q and to the cathode of a zener diode ZD1, while the negative output terminal of the bridge diode is connected to the emitter of the transistor Q. The base of the transistor Q is connected to a primary coil N1 of a ring transformer, while a node between the other end of the primary coil N1 and one end of a secondary coil N2 (which are connected together) is connected through the emitter of the transistor Q and a resistor R2 to the anode (node H5) of the zener diode ZD1. The other end of the secondary coil N2 is connected to one end of a diac DA, while the other end (node H6) of the diac DA is connected through a resistor R1 to the node H5, and is also connected through a capacitor C1 to the emitter (node H4) of the transistor Q. A bias current is not supplied to the base of the transistor Q, and therefore, an E grade operation is carried out.

The protecting circuit section protects the lighting circuit section, when the fluorescent lamp is out of order, when the lamp is taken out, or when the power source voltage is too high. Between the nodes H3 and H4, a zener diode ZD2 and resistors R3 and R7 are connected in series, while an electrolytic capacitor C2 is connected in parallel with the zener diode ZD2 and the resistor R7. Thus between the node H7 and the node H4 which are between the two resistors R3 and R7, there is obtained a low DC voltage of about 2V.

The node H6 is connected to the anode of the silicon control device SCR2, while between the nodes H7 and H4, a resistor R4 and an electrolytic capacitor C3 are connected in series. Between the node H4 and a node (between the resistor R4 and the electrolytic capacitor C3), resistors R5 and R6 are connected in series. A node between the resistors R5 and R6 is connected to the gate of the silicon control device SCR2.

The lighting circuit of the present invention constituted as above will now be described as to its operations. If power is supplied, the brightness controlling transformer T supplies an initial power through the stabilizer CH and the filaments RfA and RfB to nodes H1 and H2, i.e., the voltage circuit input terminals. In the initial stage, the silicon control device SCR1 has its gate opened, and therefore, is in a turned-off state. However, later if the transistor Q is turned on and off repeatedly at certain intervals, a breakover occurs during the positive half cycle of the input voltage by the action of a high induced voltage so as to allow conduction, with the result that the filaments RfA and RfB are supplied with currents. When the fluorescent lamp starts glow discharges, and thus when it is lighted, the transistor Q is turned off, and the silicon control device SCR1 is also maintained in a turned-off state. Further, a positive voltage is suddenly supplied to the silicon control device SCR1 which has been in a ground state, and therefore, a large voltage flows through it to turn it on. Therefore, in order to improve this phenomenon, a node between two resistors which are connected between the anode and cathode of the silicon control device SCR1 may be connected to the gate of the silicon control device SCR1.

In the case of 100 V power source, the zener diode ZD1 used has a breakdown voltage of 140 V. The circuit, which includes the transistor Q, the zener diode ZD1, the resistors R1 and R2, the primary and secondary coils N1 and N2, the diac DA and the capacitor C1, generates pulses based on a time constant which is determined by the capacitor C1 and the resistor R1. Under this condition, the transistor Q is turned on only during the phase period when the base current is absorbed from the secondary coil N2. When there is no current absorbed into the base from the secondary coil N2, the transistor Q is highly backbiased so as to be turned off. In this way, if the transistor Q is turned on and off at a high frequency (e.g., 1 KHz–20 KHz), then a high voltage pulse power flows against the barrier of the current bridge so as to appear in the nodes H1 and H2. As a result, the stabilizer CH generates a high frequency power of about 1,000–1,500 V so as to initiate the glow discharges in the fluorescent lamp, thereby lighting the fluorescent lamp. When the transistor Q is turned on, currents are supplied to the filaments RfA and RfB so as to promote the starting of the glow discharge. Further, as described above, the silicon control device SCR1 supplements the supply of the filament currents, so that a speedy starting of the glow discharge is ensured.

When the glow discharge starts, the voltage between the nodes H1 and H2 is lowered from about 200 V to about 110 V. The breakdown point of the zener diode ZD1 is about 140 V, and therefore, the oscillating circuit including the transistor Q stops the oscillations. If the glow discharge stops due to any reason, the voltage between the nodes H1 and H2 is stepped up to 200 V again, so that the oscillating circuit including the transistor Q resumed the oscillations.

If the fluorescent lamp becomes no good due to the time wearing or being taken out, the voltage between the nodes H1 and H2 is maintained at about 200 V, and the oscillation circuit continues the oscillation. Therefore, the load of the transistor Q may become excessive. The protecting circuit section solves such a problem. After an elapsed time of about 5–7 seconds (the time determined by the time constants of C3 and R4) from the supply of the power, the gate of the silicon control device SCR2 is activated so that the silicon control device SCR2 is turned on. Thus the capacitor C1 is short circuited, thereby stopping the oscillating operation of the oscillating circuit. That is, the oscillating circuit can be locked, and therefore, if the fluorescent lamp is not lighted due to any reason, then the burden of the transistor Q can be dissipated after the elapsed time of about 5–7 seconds. When the lighting of the fluorescent lamp is attempted, the power source is disconnected, and then, the power supply is resumed after capacitor has discharged the C3. FIGS. 10 to 13 illustrate graphs or wave patterns showing the operating characteristics of the present invention.

According to the present invention as described above, large and special components such as the lighting device of the rapid starting method are not required, but only small and cheap components are employed in instantly lighting the fluorescent lamp. After the lighting, a lighting state causing no power loss as in the conventional glow starter lighting method can be maintained. Further, the present invention can be easily applied to the existing glow starter lighting fluorescent lamp.

What is claimed is:

1. A fluorescent lamp lighting circuit section for a fluorescent lamp having first and second filaments connected to an alternating voltage power supply by a stabilizer, the lighting circuit section comprising:

a rectifier having first and second input terminals (H1, H2) respectively connected to the first and second filaments of the fluorescent lamp, the rectifier further having first and second output terminals (H3, H4);

a silicon controlled device connected between the first and second input terminals (H1, H2), the silicon control device is switchable between on and off states for supplying short circuit current pulses to the first and second filaments through the stabilizer, wherein the short circuit current pulses induce voltage pulses in the stabilizer which are applied to the first and second filaments so as to initiate glow discharges in the fluorescent lamp; and a transistor circuit section connected between the first and second output terminals (H3, H4), the transistor circuit section generating switching voltage pulses for switching the silicon controlled device between the on and off states during a half cycle of power from the alternating voltage power supply.

2. The lighting circuit section of claim 1 wherein:

the switching voltage pulses have a frequency between 1 to 20 KHz.

3. The lighting circuit section of claim 1 wherein the transistor circuit section comprises:

a transistor having a base, a collector, and an emitter, wherein the collector is connected to the first output terminal (H3) and the emitter is connected to the second output terminal (H4).

4. The lighting circuit section of claim 3 wherein the transistor circuit section further comprises:

a primary coil of a transformer connected between the base of the transistor and the second output terminal (H4);

a secondary coil of a transformer having first and second ends with the first end connected to the second output terminal (H4);

a diac having first and second ends with the first end connected to the second end of the secondary coil;

a timing capacitor connected between the second end of the diac and the second output terminal (H4);

a zener diode and a second resistor connected in series between the first and second output terminals (H3, H4); and a first resistor connected at a first end between the zener diode and the second resistor and connected at a second end to the second end of the diac, wherein the transistor circuit section generates the switching voltage pulses at a frequency based on a time constant determined by the timing capacitor and the first resistor.

5. The lighting circuit section of claim 1 further comprising:

a protecting circuit section operable with the transistor circuit section for disabling the generation of the switching voltage pulses.

6. A fluorescent lamp comprising:

a discharge circuit section including a tube having first and second filaments connected to an alternating voltage power supply by a stabilizer;

a rectifier having first and second input terminals (H1, H2) respectively connected to the first and second filaments of the tube, the rectifier further having first and second output terminals (H3, H4);

a silicon controlled device connected between the first and second input terminals (H1, H2), the silicon control device is switchable between on and off states for supplying short circuit current pulses to the first and second filaments through the stabilizer, wherein the short circuit current pulses induce voltage pulses in the stabilizer which are applied to the first and second filaments so as to initiate glow discharges in the tube; and a transistor circuit section connected between the first and second output terminals (H3, H4), the transistor circuit section generating switching voltage pulses for switching the silicon controlled device between the on and off states during a half cycle of power from the alternating voltage power supply.

7. The fluorescent lamp of claim 6 wherein the discharge circuit section further comprises:

a brightness controlling transformer connected in parallel with the alternating voltage power supply between the stabilizer and the second filament, the brightness controlling transformer being adjustable for controlling the brightness of the discharge of the tube by controlling the power supplied by the power supply to the filaments.

8. The fluorescent lamp of claim 6 further comprising:

a protecting circuit section operable with the transistor circuit section for disabling the generation of the switching voltage pulses.

* * * * *